US005511732A

United States Patent [19]

Kroger et al.

[11] Patent Number: 5,511,732

[45] Date of Patent: Apr. 30, 1996

[54] DOCUMENT SHREDDING MACHINE WITH CONTINUOUS STRIPPER

[75] Inventors: Bruce R. Kroger, Rockford; Richard A. Hassert, Wheaton; Anthony C. Storie, Naperville; James V. Baker, Hoffman Estates, all of Ill.

[73] Assignee: Fellowes Manufacturing Company, Itasca, Ill.

[21] Appl. No.: 365,568

[22] Filed: Dec. 28, 1994

[51] Int. Cl.[6] ..... B02C 18/16

[52] U.S. Cl. ..... 241/166; 241/236; 241/285.1

[58] Field of Search ..... 83/114, 500–503, 83/664; 241/166, 167, 235, 236, 285.1

[56] References Cited

U.S. PATENT DOCUMENTS

| | | | |
|---|---|---|---|
| 2,770,302 | 11/1956 | Lee . | |
| 3,033,064 | 5/1962 | Lee . | |
| 3,724,766 | 4/1973 | Bosland . | |
| 4,018,392 | 4/1977 | Wagner . | |
| 4,257,565 | 3/1981 | Hatanaka . | |
| 4,260,115 | 4/1981 | Hatanaka . | |
| 4,562,971 | 1/1986 | Schwelling . | |
| 4,565,330 | 1/1986 | Katoh . | |
| 4,688,730 | 8/1987 | Dahle . | |
| 4,690,340 | 9/1987 | Hatanaka . | |
| 4,693,428 | 9/1987 | Raterman et al. . | |
| 5,071,080 | 12/1991 | Herbst et al. . | |
| 5,230,477 | 7/1993 | Strohmeyer | 241/166 |
| 5,295,633 | 3/1994 | Kimbro et al. . | |
| 5,400,978 | 3/1995 | Strohmeyer | 241/166 |

FOREIGN PATENT DOCUMENTS

| | | | |
|---|---|---|---|
| 2226778 | 7/1980 | United Kingdom | 241/166 |

*Primary Examiner*—Timothy V. Eley
*Attorney, Agent, or Firm*—Willian Brinks Hofer Gilson & Lione

[57] ABSTRACT

A paper shredding machine having a top housing unremovably sealed to a lower housing. The top housing has upper teeth integrally formed on its inside surface and the lower housing has bottom teeth integrally formed on its inside such that when the top housing is joined with the lower housing and sealed, the upper teeth are unremovably joined with the lower teeth to define a continuous stripper to strip shredded material from the cutting area of the shredding mechanism. The paper shredder is made by providing a top and bottom housing with the top housing having upper teeth and the bottom housing having lower teeth. The top and bottom housings are joined and passed through an ultrasonic welding apparatus to fuse the top housing to the bottom housing and the upper teeth to the lower teeth.

2 Claims, 2 Drawing Sheets

FIG. 1
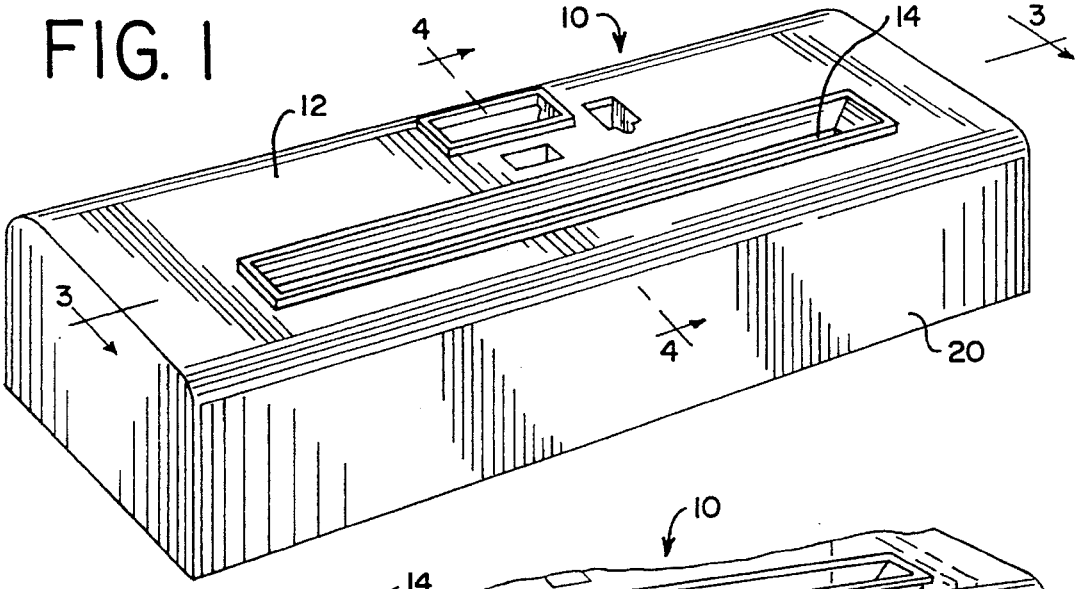
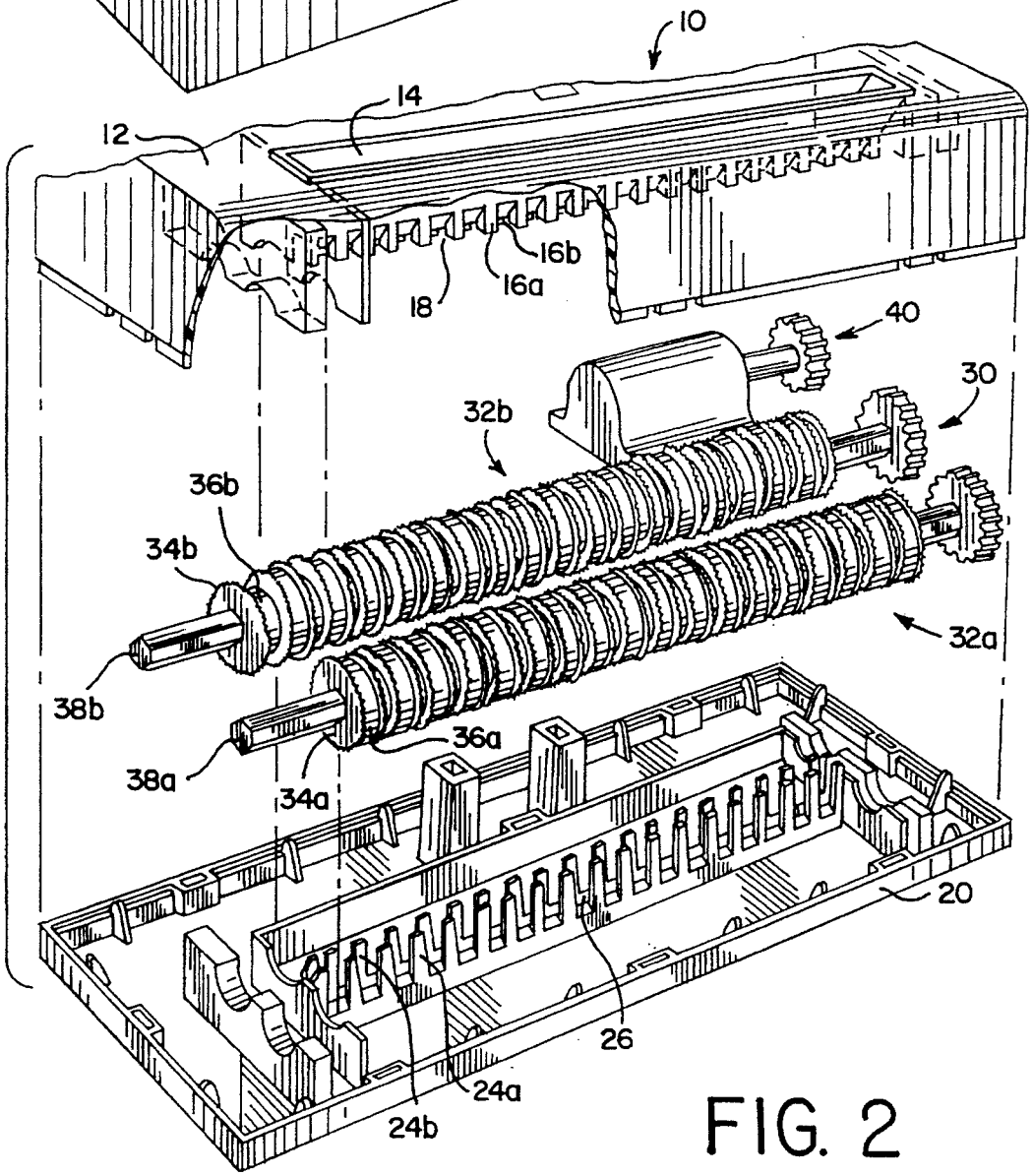
FIG. 2

DOCUMENT SHREDDING MACHINE WITH CONTINUOUS STRIPPER

BACKGROUND OF THE INVENTION

This invention relates to a sealed paper shredder having continuous strippers that are integral with the housing.

In order to destroy documents to preserve their confidentiality, shredders exist which cut the paper into narrow strips. Typically, the cutting is achieved by a series of circular cutters which are arranged along the axis of two rotating members. The cutters of one rotating member are offset so that the cutters pass between the cutters of the other member.

The actual structure of the rotating members having cutters can be a solid bar of steel or similar material in which cutters and spacers are formed by machining so that the cutters and spacers are all integral to one another. Another structure has separate cylindrical members of a larger diameter which are used as the cutters and are spaced apart by separate cylindrical spacers which are assembled on a shaft in an alternating relationship.

One problem with known and existing shredding devices is that after the paper has been cut into strips, the strips tend to wind around the cutters and spacers, clogging the cutting area. To solve this problem it has been suggested to provide strippers to strip away the cut paper. Typically, the strippers consist of a serrated member or a comb type member having teeth that protrude in the spaces between the individual cutters. These members are located on the outward or post-shredder side of the cutting area. For example, U.S. Pat. No. 4,068,805 shows a comb means rigidly placed at the exit of the cutters and extending into at least one of the cutters.

Another method of providing a stripping means is shown in U.S. Pat. No. 3,033,064 which discloses a pair of combs each having a series of spaced teeth that project into the spaces between the cutters to remove the cut strips of paper. Each comb is rigidly mounted so that the teeth protrude into the side of the cutter shaft opposite of the cutting area. In addition, they are formed in a semi-circular shape so that they wrap around the series of cutters.

In addition, it has been suggested to provide a comb type member before the cutters. The comb then guides the uncut paper into the cutters. U.S. Pat. No. 4,018,392 shows a pair of combers attached to support rods, each comber having a tongue protruding forward of the cutters to comb and direct the material being fed to the cutting surfaces of the cutters.

The problem with these shredders and others is that a number of individual parts are required. Separate parts are required for the comb assembly and for mounting to the shredder housing. This increases the time and labor required to assemble the shredder which in turn increases the cost of the shredder.

A solution to these problems is exemplified in U.S. Pat. No. 5,071,080 assigned to the same assignee as the present application and incorporated herein by reference. In this patent, the shredder has upper strippers integral with the top housing and lower strippers integral with the bottom housing such that when the housings are joined, the upper and lower strippers substantially abut to define a continuous stripper. A potential problem may occur when the shredder is overloaded causing the strippers and the housings to become separated.

The present invention prevents any potential separation by providing a sealed paper shredder having a top housing with integral upper strippers unremovably joined to a lower housing with integral lower strippers so that the upper and lower strippers are unremovably joined. The present invention also includes a method of manufacturing such a paper shredder.

SUMMARY OF THE INVENTION

The present invention provides a sealed paper shredder having a continuous stripper for removing cut material from the cutting area of a paper shredder. The shredder includes a top housing with a feed opening and a base with a discharge opening with the top housing unremovably joined with the lower housing or base to seal the paper shredder. The housings can be joined by any method that prevents them from being separated. Preferably, the housings are joined by gluing, bonding, welding, and the like. More preferably, the housings are molded from plastic and are joined by ultrasonic welding so that the top housing is fused, i.e. unremovably joined to the lower housing.

The continuous stripper extends from the inside surface of the top housing through the cutting area to the inside surface of the bottom base. In particular, the stripper extends from the feed opening through the cutting area and to the discharge opening. The stripper consists of upper teeth integrally formed on the inside surface of the top housing and lower teeth integrally formed on the inside surface of the bottom or lower housing to form the continuous stripper. The upper teeth are unremovably joined with lower teeth by gluing, bonding, welding, and the like. More preferably, the housings are molded from plastic so that the upper and lower teeth are integrally molded with the top and bottom housings, respectively, and are unremovably joined by ultrasonic welding so that when the top housing is unremovably joined to the lower housing, the upper and lower teeth are likewise unremovably joined to form a continuous stripper. The continuous stripper therefore prevents the cut material from winding around the cutting mechanism, clogging the shredder and separating the strippers.

This arrangement therefore provides a stripper both before and after the cutter surface. The stripper can guide the paper into the cutting surface and prevent the cut paper strips from clogging the cutting area. Furthermore, because the teeth are molded as part of the housing and the base, no mounting parts or assembly labor is required for the stripper. This results in a shredder having a cost less than that of a conventional paper shredder.

BRIEF DESCRIPTION OF THE DRAWINGS

FIG. 1 is a perspective view of an assembled paper shredder with the top housing unremovably joined to the lower housing.

FIG. 2 is an exploded view of the paper shredder of FIG. 1.

DETAILED DESCRIPTION OF THE INVENTION AND PREFERRED EMBODIMENTS

Figure 3:
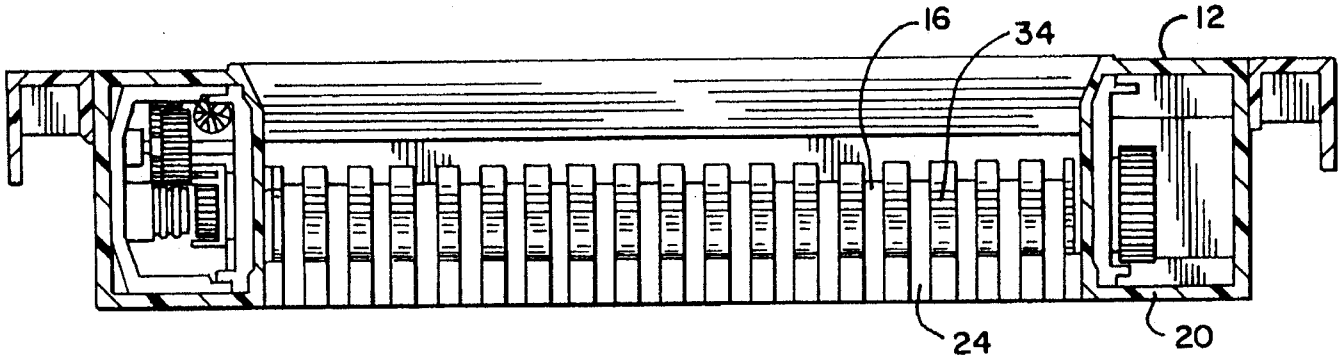
FIG. 3 is a cross section of the paper shredder taken along line 3—3 of FIG. 1 that shows the top housing, including the upper teeth, fused, i.e., unremovably joined to the lower housing, including the lower teeth.
Figure 4:
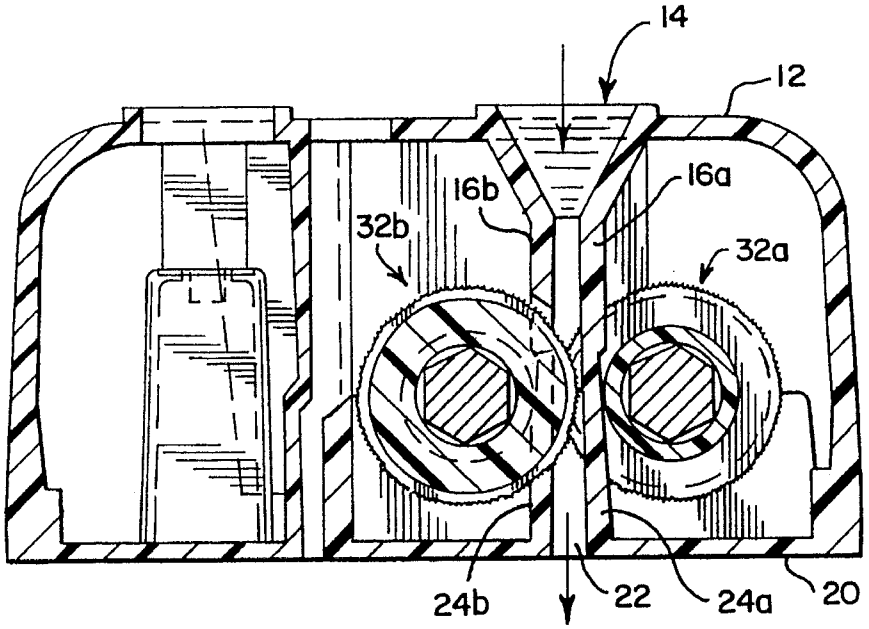
FIG. 4 is a cross section of the paper shredder taken along line 4—4 of FIG. 1 that shows the top housing, including the upper teeth, fused, i.e., unremovably joined to the lower housing, including the lower teeth.

FIG. 1 shows the assembled paper shredder 10 of the most preferred embodiment of the present invention. More particularly, the paper shredder has a top housing 12 that is fused to a lower housing 20. FIG. 2 shows an exploded view of the paper shredder of FIG. 1 prior to fusing the top and bottom housing.

The top housing 12 has feed opening 14 through which the paper to be shredded is fed. Extending downward from the top housing, and in particular from each side of the feed opening, are a plurality of spaced apart upper teeth 16*a* and 16*b*. The teeth 16*a* and 16*b* are spaced at regular intervals to provide a space 18 between each tooth. Also, upper teeth 16*a* on one side of the feed opening extend downward while on the other side of the feed opening there is a space 18 between the teeth. Thus, upper teeth 16*a*, 16*b* extend downward in alternating fashion.

The lower or bottom housing has a discharge opening 22 through which the shredded paper exits. Extending upward from the bottom housing, and in particular from each side of the discharge opening, are a plurality of spaced apart lower teeth 24*a* and 24*b*. Like the upper teeth, the lower teeth 24*a* and 24*b* are spaced at regular intervals to provide a space 26 between each tooth. Also, lower teeth 24*a* on one side of the discharge opening extend upward while on the other side of the discharge opening there is a space 26 between the teeth. Thus, lower teeth 24*a*, 24*b* extend upward in alternating fashion.

Generally, the upper teeth extend downward into the cutting area while the lower teeth extend upward into the cutting area to substantially abut the upper teeth when the top housing contacts the lower housing. It will therefore be appreciated that when the top housing is lowered and contacts the lower housing, the upper teeth 16*a*, 16*b* will contact the lower teeth 24*a*, 24*b*, respectively, to form a continuous stripper in the manner fully explained in U.S. Pat. No. 5,071,080 which is incorporated herein by reference in its entirety.

A cutting mechanism 30 is provided to shred the paper inserted into the feed opening. In general, cutting cylinders 32*a* and 32*b* are arranged in parallel and interleave to form a nip to define a cutting area. The cylinders have cutter discs 34*a*, 34*b* alternately spaced by spacers 36*a*, 36*b* and mounted on a shaft 38*a*, 38*b*. The discs extend through the spaces 18 and 26 between the upper and lower teeth defining the cutting area. Since the particulars of the cutting mechanism is not the subject of the present invention, it will be understood that any cutting mechanism known to those skilled in the art may be used.

An appropriate gear 40 driven by a motor is coupled to the shafts to drive the cutting cylinders 32*a* and 32*b* in opposite directions so that the discs 34*a*, 34*b* grasp and pull the paper into and through the cutting area so that paper is cut into thin strips. It will be appreciated that a suitable switch can be used to actuate the motor. Alternatively, an electric eye switch can be provided in the feed opening to automatically activate the motor.

During manufacture of the paper shredder of the present invention, the internal mechanisms including the cutting cylinders, motor, gears and the like are positioned and the upper housing is lowered onto the lower housing. The upper housing, including the upper teeth, is then unremovably joined to the lower housing, including the lower teeth, to seal the paper shredder. The housings can be joined by any method that prevents them from being separated. Preferably, the housings are joined by gluing, bonding, welding, and the like. More preferably, the housings are molded from plastic and are joined by ultrasonic welding so that the top housing is fused to the lower housing. In this more preferred embodiment, it will be understood that during the process of ultrasonic welding the upper teeth will be fused to the lower teeth. As a result, a sealed paper shredder is produced with a single continuous stripper that extends from the feed opening through the cutting area and to the discharge opening.

Alternatively, the upper teeth may extend downward into and through the cutting area and terminate at the discharge opening. Thus, when the top and bottom housings are ultrasonically welded, the upper teeth will be unremovably joined to the discharge opening to provide a continuous stripper. Likewise, the lower teeth may extend upward into and through the cutting area and terminate at the feed opening. When the top and bottom housings are ultrasonically welded, the lower teeth will be unremovably joined to the feed opening to provide a continuous stripper.

It should be understood that a wide range of changes and modifications can be made to the embodiments described above. It is therefore intended that the foregoing description illustrates rather than limits this invention, and that it is the following claims, including all equivalents, which define this invention.

What is claimed:

1. A paper shredding machine including a cutting mechanism that defines a cutting area, the paper shredder comprising:

a. a top housing unremovably joined to a bottom housing;

b. a continuous stripper that extends from the top housing through the cutting area and to the bottom housing comprising upper teeth integrally formed onto the top housing and unremovably joined to lower teeth integrally formed onto the bottom housing.

2. The paper shredding machine of claim 1 wherein the top housing is fused to the bottom housing and the upper teeth are fused to the lower teeth.

* * * * *